United States Patent [19]

Röck et al.

[11] Patent Number: 4,850,659

[45] Date of Patent: Jul. 25, 1989

[54] FASTENING DEVICE FOR ADJUSTABLE FRONT PLATES OF DRAWERS

[75] Inventors: Erich Röck, Höchst; Klaus Brüstle, Lauterach, both of Austria

[73] Assignee: Julius Blum Gesellschaft G. m.b.H., Höchst, Austria

[21] Appl. No.: 115,034

[22] Filed: Oct. 30, 1987

[30] Foreign Application Priority Data

Nov. 12, 1986 [AT] Austria ..... 3002/86

[51] Int. Cl.[4] ..... A47B 48/00

[52] U.S. Cl. ..... 312/263; 312/330.1; 403/329

[58] Field of Search ..... 312/263, 330 R; 403/329, 407.1, 409.1

[56] References Cited

U.S. PATENT DOCUMENTS

| | | | |
|---|---|---|---|
| 2,874,388 | 2/1959 | Edelen, Sr. . | |
| 4,005,328 | 11/1987 | Rock et al. | 312/263 X |
| 4,264,113 | 4/1981 | Suttles . | |
| 4,458,965 | 7/1984 | Ohlendorf et al. | 312/330 P |
| 4,502,807 | 3/1985 | Salice . | |
| 4,507,010 | 3/1985 | Fujiya . | |
| 4,520,608 | 6/1985 | Baus | 403/329 X |
| 4,609,236 | 9/1986 | Twellmann . | |
| 4,649,712 | 3/1987 | Tate et al. | 403/329 |
| 4,690,469 | 9/1987 | Grass | 312/330 R |
| 4,741,583 | 5/1988 | Röck et al. . | |

FOREIGN PATENT DOCUMENTS

| | | | |
|---|---|---|---|
| 96898 | 12/1983 | European Pat. Off. | 312/330 R |

*Primary Examiner*—Joseph Falk

*Attorney, Agent, or Firm*—Wenderoth, Lind & Ponack

[57] ABSTRACT

A fastening device for adjustably mounting each side of a front plate of a drawer includes a supporting part fastened to a respective side wall at each side of the drawer. A holding part is fastened, for example by means of screws, to the respective side of the drawer and engages the supporting part. A spring, preferably a leaf spring, is depth-adjustably mounted on each supporting part by means of an eccentric, the holding part engaging such spring by means of a hook. The holding part has a rearwardly open horizontal slot into which fits another eccentric which is mounted on the supporting part.

16 Claims, 4 Drawing Sheets

FASTENING DEVICE FOR ADJUSTABLE FRONT PLATES OF DRAWERS

FIELD AND BACKGROUND OF THE INVENTION

The present invention relates to a fastening device for each side of an adjustable front plate of a drawer and including a support part fastenable in a double-walled drawer side wall at a respective side of the drawer, and a holding part, fastenable, for example by means of screws, to the respective side of the front plate to engage in the respective supporting part and retained therewith by means of a spring.

DESCRIPTION OF THE PRIOR ART

A fastening device of the above-described type is known, for example, from DE-OS No. 31 48 066. By means of a fastening device of this type the front plate can be quickly anchored to the drawer, when an article of furniture is being assembled, and it is further possible to adjust the position of the drawer front plate to obtain equal vertical and horizontal gaps between a plurality of drawers. A further example of anchoring the front plate to a drawer in the above-described manner is shown in EP-No. A1-160733.

Lately an increasing number of drawers with doublewalled drawer side walls have been put on the market. The drawer side walls may be made of plastic material or metal. In the latter case, the side walls frequently also have the function of pull-out rails.

SUMMARY OF THE INVENTION

It is the object of the invention to provide a fastening device of the above-described type which is particularly suitable for use with such drawer side walls. It should be possible to secure the front plate quickly to the drawer side walls and to then adjust its precise position and to fix it in such position.

According to the invention this object is achieved in that a spring, preferably a leaf spring, is perpendicularly movable relative to the front plate by means of an eccentric. Holding parts of the front plate need only be pushed into supporting parts mounted in the side walls, whereupon the drawer is immediately locked in position. No particular tool is required for this operation. Then the front plate can be adjusted vertically and laterally of the article of furniture. When the front plate has been so adjusted, the springs are pulled backward by turning respective eccentrics, and the front plate then is clamped to the fronts of the drawer side wall.

The lateral adjustability of the front plate is advantageously achieved in that the holding parts comprise two parts, and that clamping elements are arranged between such two parts which are slidably hooked to each other.

An embodiment of the invention provides that each leaf spring has a recess into which a hook of the respective holding part engages.

A further embodiment of the invention provides that each holding part has a rearwardly open horizontal slot into which extends an eccentric which is mounted on the respective supporting part. A vertical adjustment of the front plate is thereby obtained. By turning the eccentric of the holding part is lifted or lowered. The horizontal adjustment of the front plate also obviously can be effected in this manner. It is advantageously provided that the eccentric is mounted in the region of a recess in the spring. It is further provided that the horizontal slot divides the hook.

A preferred embodiment of the invention provides that the supporting parts and the holding parts are inserted into double-walled drawer side walls to which the supporting parts are fastened, for example screwed thereto.

One of the two parts which form each holding part is provided with a T-shaped shoulder which is guided in a correspondingly shaped recess of the other part. In this way a particularly good fit of the two parts is obtained, thus also providing good guiding of the front plate during lateral adjustment.

The spring in which the holding part engages is advantageously arranged under tension in a slot in the supporting part.

One embodiment of the invention provides that the clamping element is an eccentric which is mounted in recesses of the parts of each respective holding part, such recesses complementing each other to form a cylinder.

BRIEF DESCRIPTION OF THE DRAWINGS

In the following an embodiment of the invention will be described in more detail with reference to the accompanying drawings, without being limited thereto, and wherein.

DESCRIPTION OF THE PREFERRED EMBODIMENT

Figure 1:
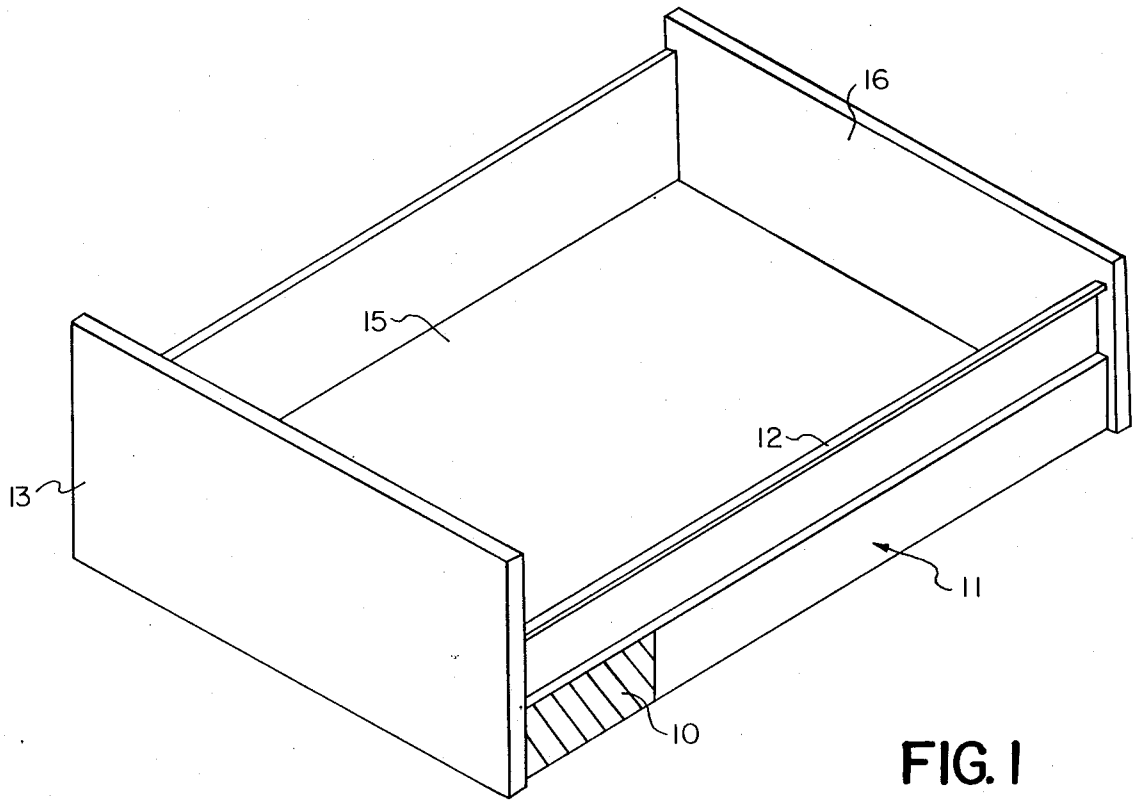
FIG. 1 is a perspective view of a drawer with fastening devices for a front plate thereof according to the invention.

The essential parts of the drawer are two drawer side walls 1, a front plate 13, a bottom 15 and a rear wall 16. A fastening device 10 according to the invention is fitted into the front end of each drawer side wall 11.

Holding members or parts 20 are fastened to opposite sides of the front plate 13. Each holding part 20 comprises two parts 1 and 2, part 1 being fastened directly to the front plate 13 and part 2 being held on part 1. Part 1 has a T-shaped shoulder 17 which is guided in a corresponding groove 18 in part 2. When the front plate 13 has been mounted, it is movable laterally by shoulder 17 of parts 1 sliding in grooves 18 of parts 2.

Eccentrics 3 are arranged in recesses 19 between parts 1 and 2. After lateral adjustment of front plate 13, the eccentrics are rotated and tightened so that parts 1, 2 are fixed with respect to each other. Part 2 of each hook member 20 is provided at both lateral sides thereof with hooks 25 (see FIG. 5).

Supporting members or parts 7 in the form of flat housings ar fitted into double-walled drawer side walls 11. An outer wall 21 of each drawer side wall 11 has an opening 22 which provides access for an adjusting tool to supporting part 7 and hence to eccentrics 4, 6 mounted therein. Each supporting part 7 has a slot-shaped cavity 23 into which is fitted a leaf spring 5 that is held additionally by means of a respective eccentric 6. The leaf spring 5 has a recess 24.

For mounting the front plate 13 on side walls 11, the holding parts 20 are fitted into the side walls 11 and into the supporting parts 7 thereof. One hook 25 of each part 2 of each holding part 20 engages in a recess 24 of the respective spring 5. The front plate 13 is thus quickly mounted on the drawer side walls 11 without the necessity of a tool.

The possibility of laterally adjusting the front plate by displacing parts 1 with respect to parts 2 has been discussed above.

Eccentrics 4 for the vertical adjustment of front plate 13 relative to side walls 11 are mounted in the supporting parts 7 in the regions of the recesses 24 of respective springs 5. Each part 2 has therein one horizontal slot 26, in the region of the hooks 25, such slot being rearwardly open, i.e. towards the rear wall 16 of the drawer. When each holding part 20 is inserted into the supporting part 7 to be held by the respective spring 5, portions of part 2 above and below slot 26 embrace the eccentric 4 at the top and at the bottom thereof. By turning each eccentric 4, the front plate 13 thus can be lifted or lowered at each side of the drawer.

When the front plate 13 is in the correct position, the eccentrics 6 that extend through respective springs 5 are turned, and the springs thereby are pulled backwardly at each side of the drawer due to engagement of hook 25 with spring 5. The front plate 13 is thus pressed toward the front faces of the drawer side walls 11.

Figure 5:
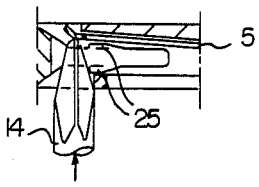
FIG. 5 is a section of area A of FIG. 4, indicating the front plate being removed.
Figure 6:
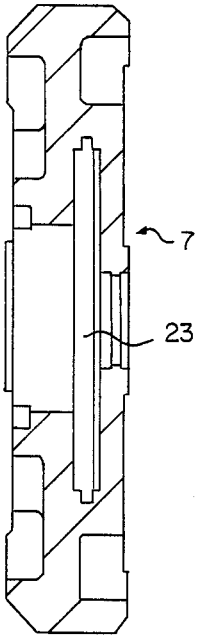
FIG. 6 is a transverse section of a supporting part of the fastening device according to the invention.
Figure 7:
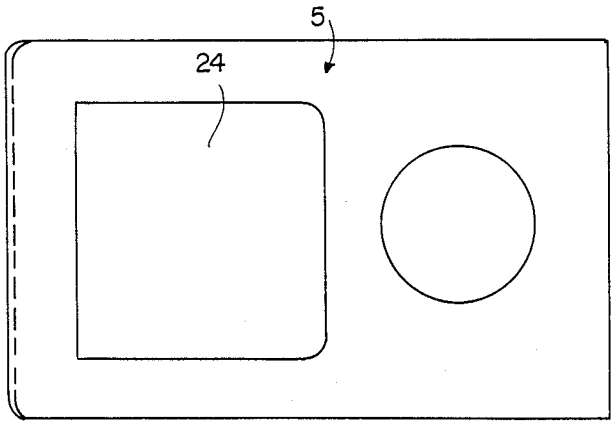
FIG. 7 is a side view of a spring thereof.
Figure 8:
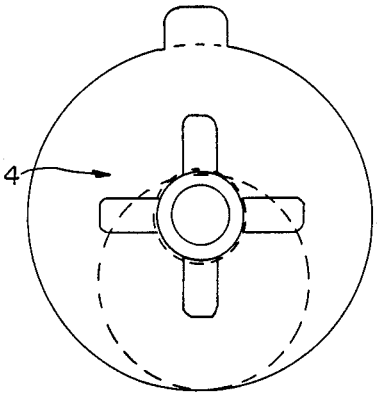
FIG. 8 is a top view of an eccentric for vertical adjustment thereof.

FIG. 5 shows that the front plate 13 can easily be removed by inserting a screw driver 14 through slot 26 in part 2 and pressing spring 5 backwardly, i.e. away from hook 25. It will obviously be of advantage to turn eccentric 6 previously in such a manner that spring 5 is loosened.

Figure 3:
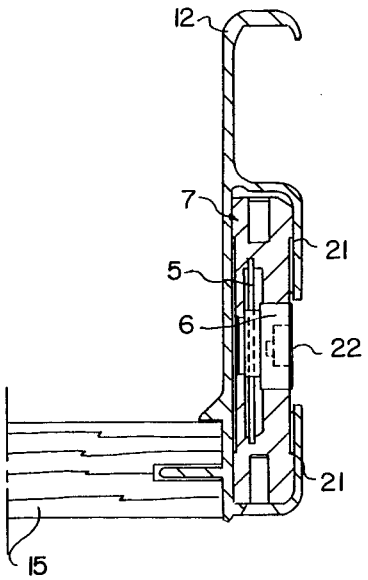
FIG. 3 is a sectional view along line III—III of FIG. 2.
Figure 2:
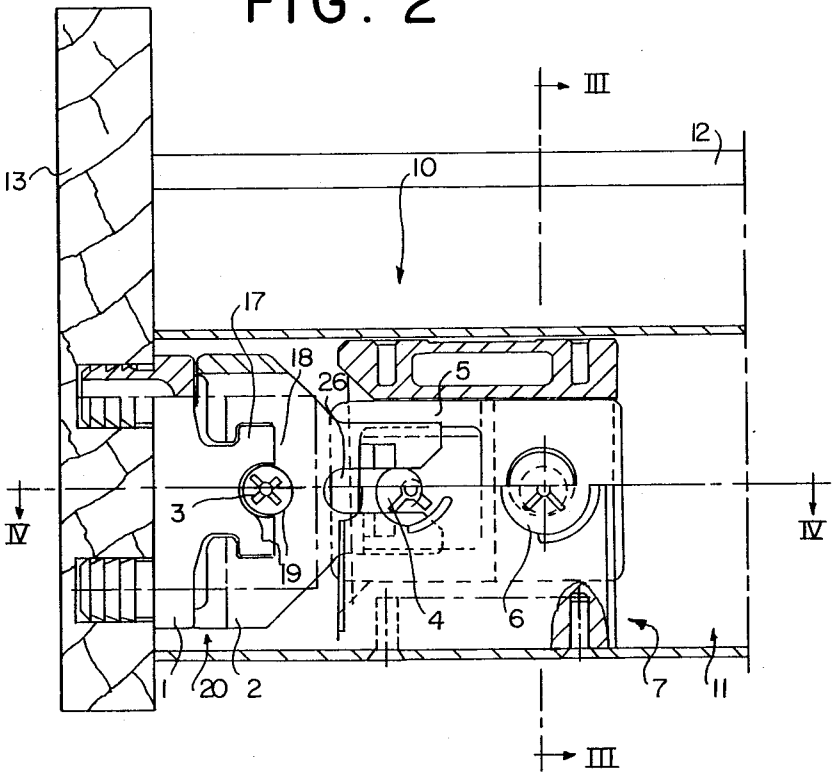
FIG. 2 is is a longitudinal sectional view of a drawer side wall in the area of the front thereof and of a fastening device according to the invention.
Figure 4:
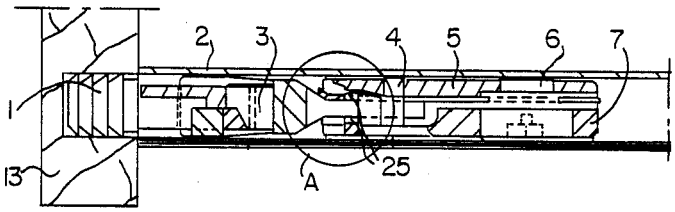
FIG. 4 is a horizontal sectional view of a fastening device according to the invention.

As can particularly be seen in FIG. 3, a horizontal flange 12 is formed at the top of each drawer side wall 11, flange 12 having the function of a pull-out rail of a pull-out guide assembly.

We claim:

1. A fastening device for use in adjustably mounting each of opposite sides of a front plate of a drawer to a respective side wall of the drawer, said fastening device comprising:

a holding member to be fastened to a respective side of the front plate;

a supporting member to be fastened to a respective side wall of the drawer;

a spring member mounted in said supporting member for sliding movement relative thereto in opposite directions toward and away from said holding member and the drawer front plate;

said holding member and said spring member having cooperating means for, upon said holding member being moved toward the drawer side wall, engaging said holding member with said spring member and thus supporting the drawer front plate in an initially fastened position; and eccentric means, mounted on said supporting member, for moving said spring member relative to said supporting member in said direction away from the front plate and thereby for, when said holding member and said spring member are engaged, moving said holding member and thus the front plate to a final fastened position, whereat further movement of the front plate is prevented by the front of the side wall.

2. A device as claimed in claim 1, wherein said holding member comprises first and second parts slidably engaged with each other.

3. A device as claimed in claim 2, wherein said first part has a T-shaped protrusion slidably fitting into a correspondingly shaped recess in said second part.

4. A device as claimed in claim 2, wherein said first and second parts are slidable relative to each other in opposite lateral directions.

5. A device as claimed in claim 2, further comprising clamping means for fixing the relative position between said first and second parts.

6. A device as claimed in claim 5, wherein said first and second parts have therein facing recesses, and said clamping means comprises an eccentric mounted in said facing recesses in said first and second parts.

7. A device as claimed in claim 6, wherein said recesses together form a cylinder.

8. A device as claimed in claim 1, wherein said cooperating engaging means on said holding member and said spring member comprise a recess in said spring member and a hook on said holding member capable of hooking into said recess upon said holding member being inserted into the drawer side wall.

9. A device as claimed in claim 8, wherein said holding member has therein a rearwardly open slot, and further comprising an eccentric rotatably mounted on said supporting member and extending into said slot, such that rotation of said eccentric moves said holding member and thus the front plate vertically upwardly or downwardly.

10. A device as claimed in claim 9, wherein said eccentric extends into said recess in said spring member.

11. A device as claimed in claim 9, wherein said slot extends through said hook.

12. A device as claimed in claim 1, further comprising an eccentric rotatably mounted on said supporting member and cooperable with said holding member such that rotation of said eccentric moves said holding member and thus the front plate vertically upwardly or downwardly.

13. A device as claimed in claim 1, wherein the drawer side wall is to be of a double-wall construction, and said holding member and said supporting member are dimensioned to fit within the double-wall drawer side wall.

14. A device as claimed in claim 1, wherein said spring member comprises a leaf spring.

15. A device as claimed in claim 14, wherein said leaf spring is slidably mounted in a slot within said supporting member.

16. A device as claimed in claim 15, wherein said leaf spring extends in a plane to be perpendicular to the drawer front plate and to a bottom of the drawer.

* * * * *